United States Patent [19]

Jeavons

[11] Patent Number: 4,824,152

[45] Date of Patent: Apr. 25, 1989

[54] VEHICLE DOOR LATCH

[75] Inventor: Philip S. Jeavons, Birmingham, England

[73] Assignee: Rockwell Automotive Body Components (UK) Ltd., United Kingdom

[21] Appl. No.: 83,858

[22] PCT Filed: Oct. 20, 1986

[86] PCT No.: PCT/GB86/00639

§ 371 Date: Aug. 7, 1987

§ 102(e) Date: Aug. 7, 1987

[87] PCT Pub. No.: WO87/02738

PCT Pub. Date: May 7, 1987

[30] Foreign Application Priority Data

Oct. 25, 1985 [GB] United Kingdom ..... 8526426

[51] Int. Cl.[4] ..... E05C 3/16

[52] U.S. Cl. ..... 292/216

[58] Field of Search ..... 292/216, 280, 201, 207, 292/106, DIG. 65

[56] References Cited

U.S. PATENT DOCUMENTS

| | | | |
|---|---|---|---|
| 1,352,762 | 9/1920 | Schultze | 292/207 X |
| 1,412,544 | 4/1922 | Wollesen | 292/207 X |
| 3,334,935 | 8/1967 | Eddey | 292/216 |
| 3,601,883 | 8/1971 | Arlauskas | 29/434 |
| 3,751,088 | 8/1973 | Schlage et al. | 292/201 |

FOREIGN PATENT DOCUMENTS 1238050 7/1971 United Kingdom .

*Primary Examiner*—Richard E. Moore

*Attorney, Agent, or Firm*—Sheldon & Mak

[57] ABSTRACT

A vehicle door latch of the kind having a latch bolt with a rotating fork or claw which cooperates with a door postmounted striker is provided which comprises two separate pawl plungers which can be independently urged into a coacting relationship with an engaging face of the bolt to retain the bolt at a safety position (at which the door is near closed) and at a fully latched position (at which the door shut). Both plungers can be withdrawn electrically and/or manually to free the bolt for opening the door.

8 Claims, 7 Drawing Sheets

VEHICLE DOOR LATCH

This invention relates to latches for vehicle doors.

More particularly the invention relates to a vehicle door latch of the kind including a latch bolt for interaction with a striker formation of the door frame in use, the bolt in a latched position keeping the door fully closed, retention means cooperating with the bolt to secure it at the latched position, and release means connectible with a door handle or other operating means to actuate the retention means for freeing the bolt to allow the door to open, said latches being hereinafter referred to as "latches of the kind described".

The object of the invention is to provide a latch of the kind described which is of simple construction and economical to manufacture and install; which gives particularly secure fastening of the door for added safety, e.g. on impact with the door, and resistance to unauthorised entry; which is durable and reliable in use; and which can readily be adapted to servo operation e.g. in a central door locking system and/or be readily provided with sensor means for automatic monitoring of its operation.

While the invention is primarily concerned with latches of the kind described in which the latch bolt is a rotatably mounted fork or claw having a mouth in which a cylindrical portion of the striker formation is received it is contemplated that the invention may be applicable to latches having rectilinearly sliding or other forms of bolt.

According to a first aspect of the invention there is provided a vehicle door latch of the kind described in which the retention means has first and second pawl members each resiliently urged independently of the other into coacting relationship with the bolt, the release means acting to shift both pawl members to free the bolt for movement from the latched position.

Preferably said pawl members co-act respectively with separate engaging faces of the bolt.

It is also preferred that the first pawl member acts to block movement of the bolt in a direction away from the latched position when the bolt and striker reach a safety position at which the door is not fully closed in use and that the second pawl member acts to block movement of the bolt when the latter is at the latched position.

It is further preferred that each pawl member makes only one unidirectional movement during each full latching cycle; conveniently said movement is rectilinear though rotary or other translatory movement is also contemplated.

Desireably the pawl members move in paths intersecting the plane in which the latch bolt moves e.g. they move in paths normal to said plane so that they are subjected to shear forces when in coacting relationship with the bolt.

According to a further aspect of the invention there is provided a door latch of the kind described in which the retention means is moved relative to the bolt by lateral translation within the body of the latch, the release means being enclosed within said body so as to render more difficult any attempt to release the latch or interfere with the latch mechanism in unauthorised manner e.g. to break into the vehicle when locked.

A latch according to the invention as defined by either of the aspects referred to above may further include (a) servo operating means in the form of a power operated actuator built into the body of the latch for selective operation of the release means and/or connection thereof with a door handle or other manual operating means, and/or (b) sensor means for monitoring operation of the latch by response to the positioning of the bolt in the latch body, in particular providing a signal according to whether the bolt is at the fully latched position or not at that position e.g. at the safety position.

Conveniently the release means includes a formation of the latch which is pushed inwardly of the latch body to shift the retention means and free the bolt, said formation being actuated by a push-rod or the like connected to a door handle and having an end in abutment with said formation but not otherwise linked thereto whereby in use any bending or other distortion or displacement of the end of the rod away from the latch, e.g. due to impact by an occupant of the vehicle on an inner face of the door in a collision or other accident, does not cause release of the latch.

One practical example of the invention is now more particularly described with reference to the accompanying drawings wherein.

Figure 2:
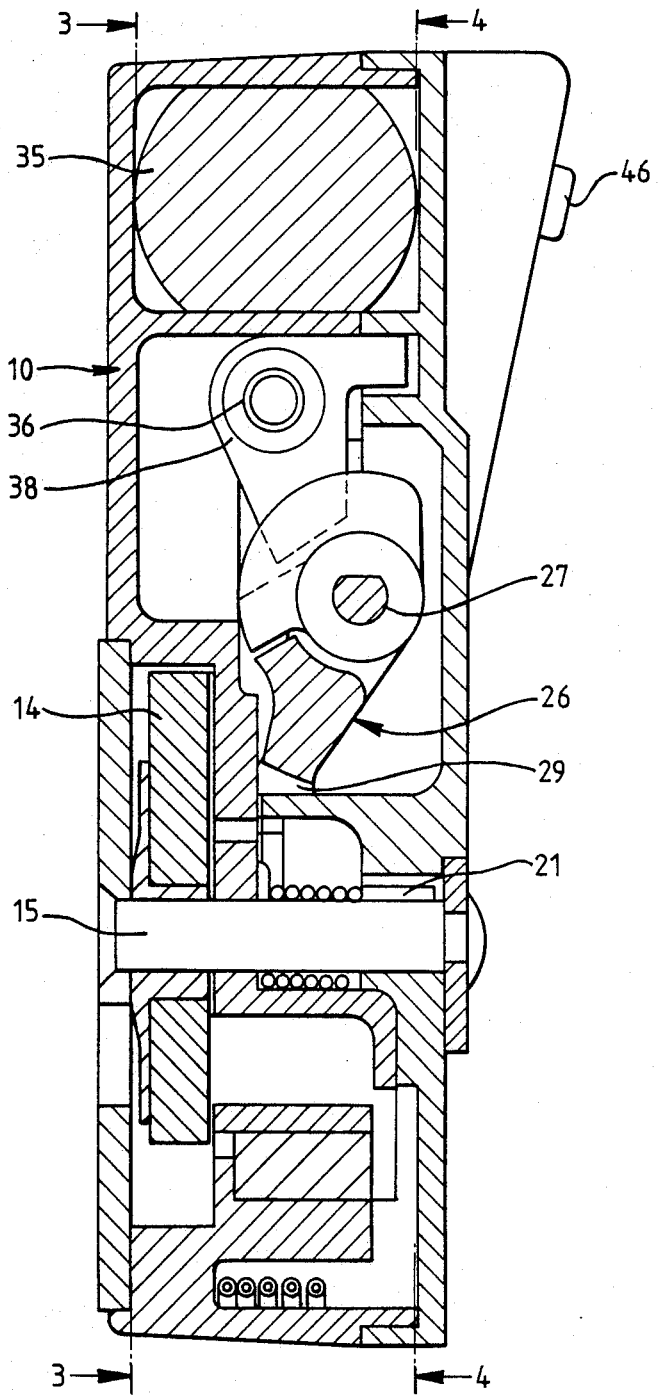
FIG. 2 is a vertical section on line 2—2 of FIG. 1.
Figure 3A:
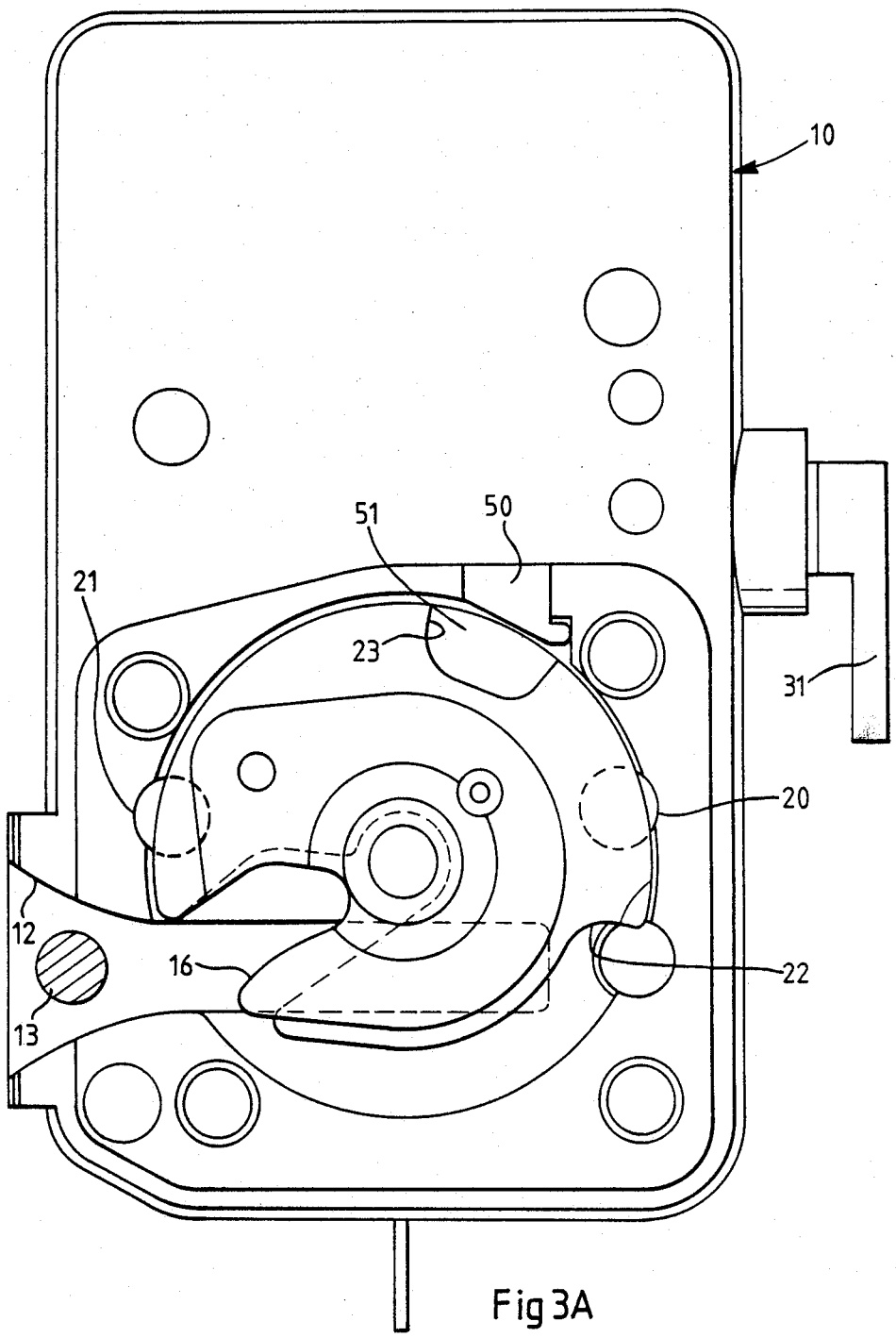
Figure 4:
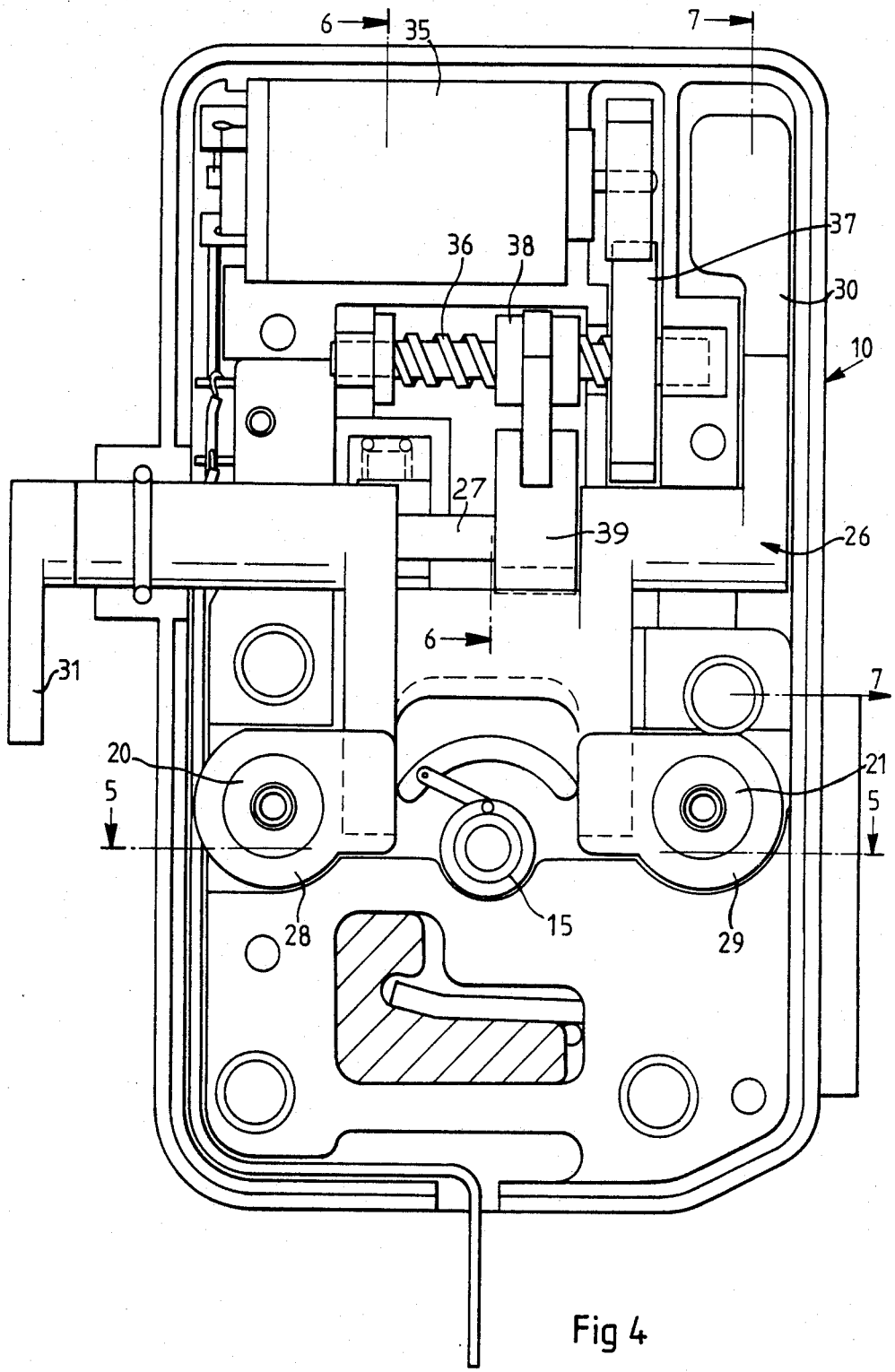
Figure 5:
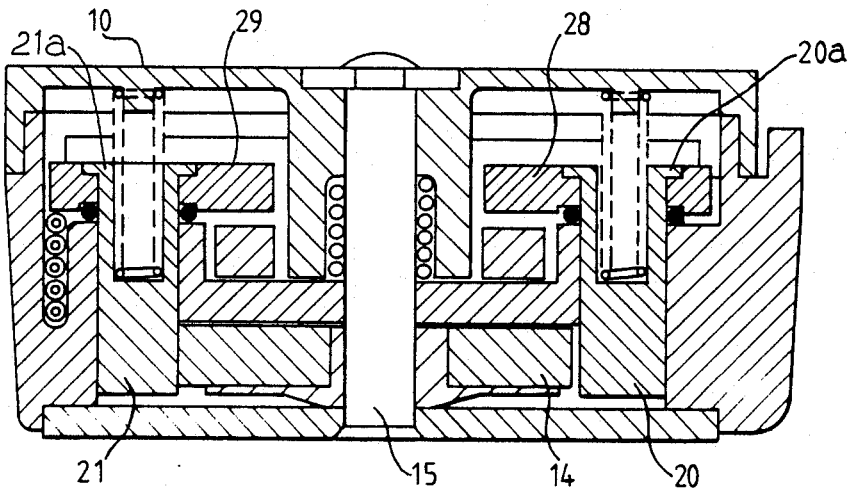
Figure 6:
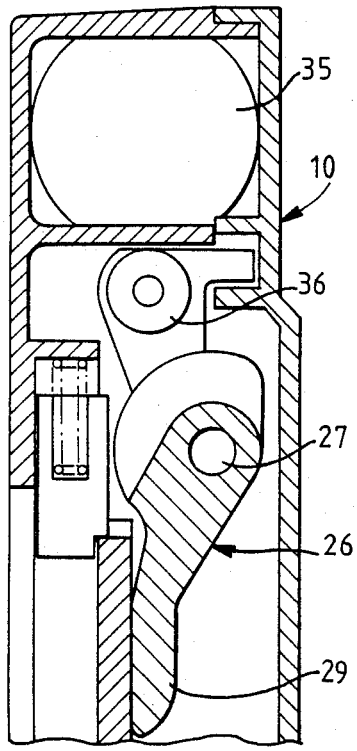

FIGS. 3A, B and C are vertical sections on line 3—3 of FIG. 2 showing the bolt and associated retention pawls at respective operating positions;

FIG. 4 is a vertical section on line 4—4 of FIG. 2;

FIG. 5 is a horizontal section on line 5—5 of FIG. 4;

FIG. 6 is a vertical part section on line 6—6 of FIG. 4, and

Figure 7:
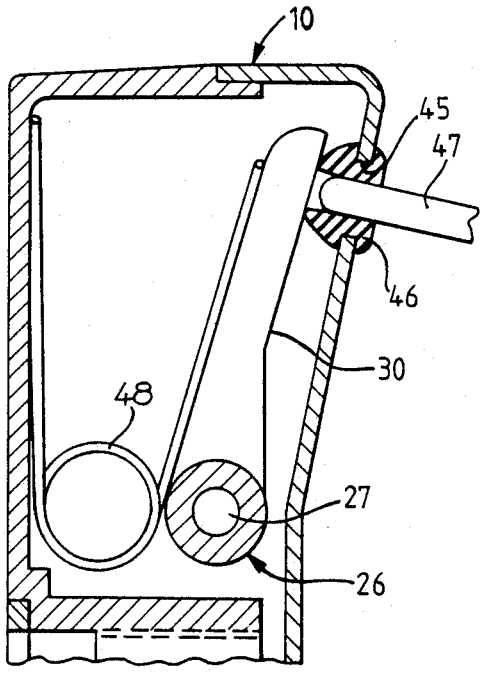

FIG. 7 is a vertical part sectional view on line 7—7 of FIG. 4.

Figure 1:
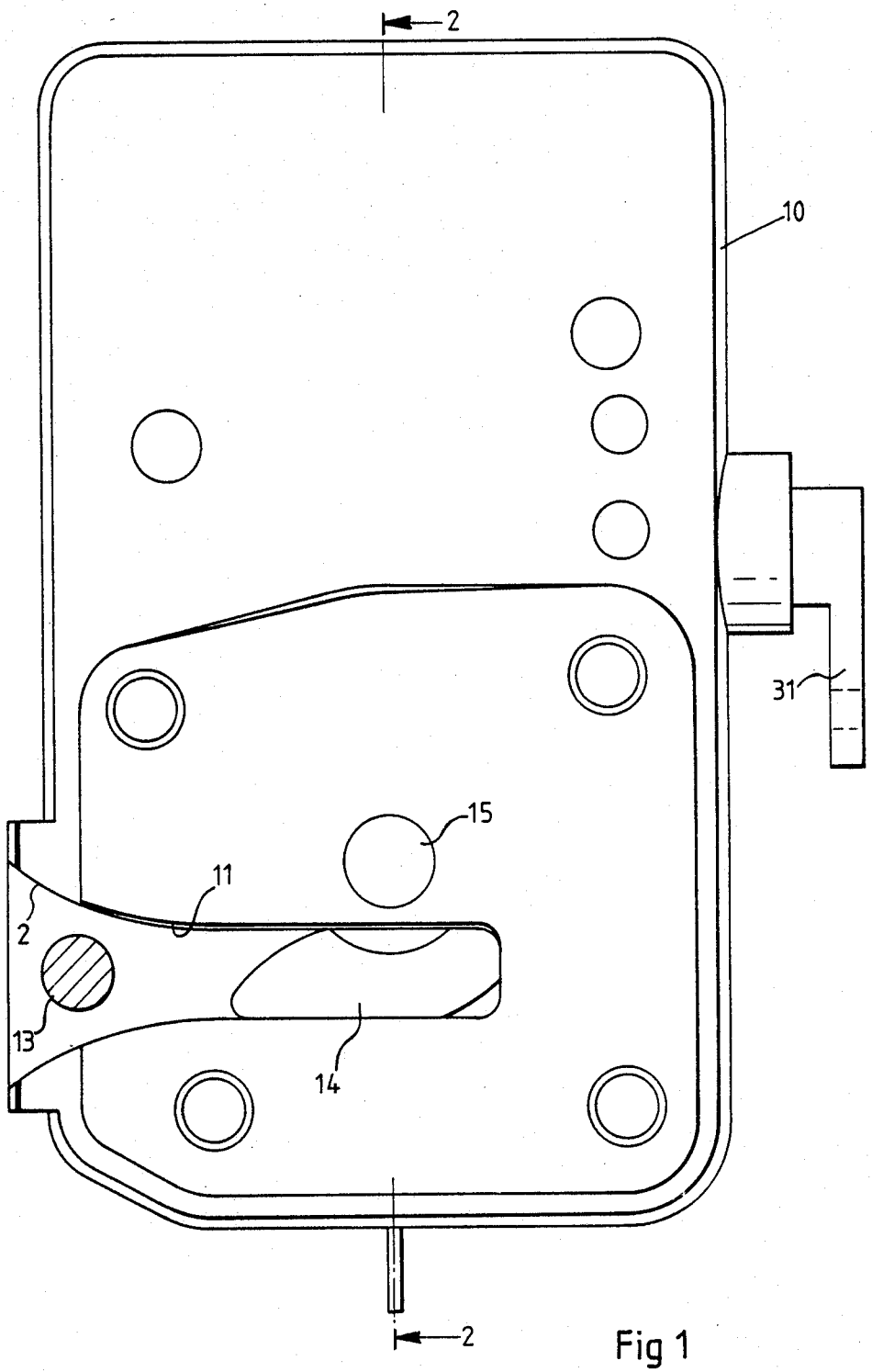
FIG. 1 is a side view of a vehicle door latch.

Referring to the drawings a vehicle door latch of the kind described incorporating the invention includes a strong box-like casing or body 10 which substantially encloses the entire mechanism of the latch and which may be formed as an assembly of mouldings of high duty plastics. A slot 11 (FIG. 1) extends along a lower side portion of the body from a forwardly directed mouth 12 for receiving a door post mounted striker, a coacting part 13 of which is indicated in FIGS. 1 and 3, in known manner. A latch bolt 14 in the form of a rotatably mounted fork or claw formation is pivoted on a shaft 15 extending laterally of body 10 so that it rotates in a plane normal to the axis of striker part 13, the latter being received in a generally radially outwardly directed gap 16 of the bolt, again in known manner.

Bolt retention means of the latch comprises a pair of pawl members which coact with respective engaging faces of bolt 14 as described hereinafter. In this example of the invention the pawl members take the form of first and second cylindrical metal plungers 20, 21 located in respective bores of body 10 parallel to shaft 15 and at almost diametrically opposite positions relative thereto to the back and front of the shaft respectively. Each plunger is springloaded so that each is resiliently urged independently of the other for movement in paths which intersect the plane of rotation of bolt 14 at right angles.

The sequence of operation of this part of the mechanism is as follows and is shown in FIGS. 3A, B, and C.

Referring firstly to FIG. 3A, with striker part 13 clear of slot 11 (i.e. with the door free to swing open or closed) bolt 14 is angularly positioned with gap 16 ready to receive part 13 as the latter enters the mouth 12 on closing the door and in this position bolt 14 is free to rotate anticlockwise as viewed in FIG. 3 towards its latched position, distal end faces of the plungers 20, 21 bearing against the inner side face of a peripheral margin of latch 14 which keeps the plungers retracted.

Figure 3B:
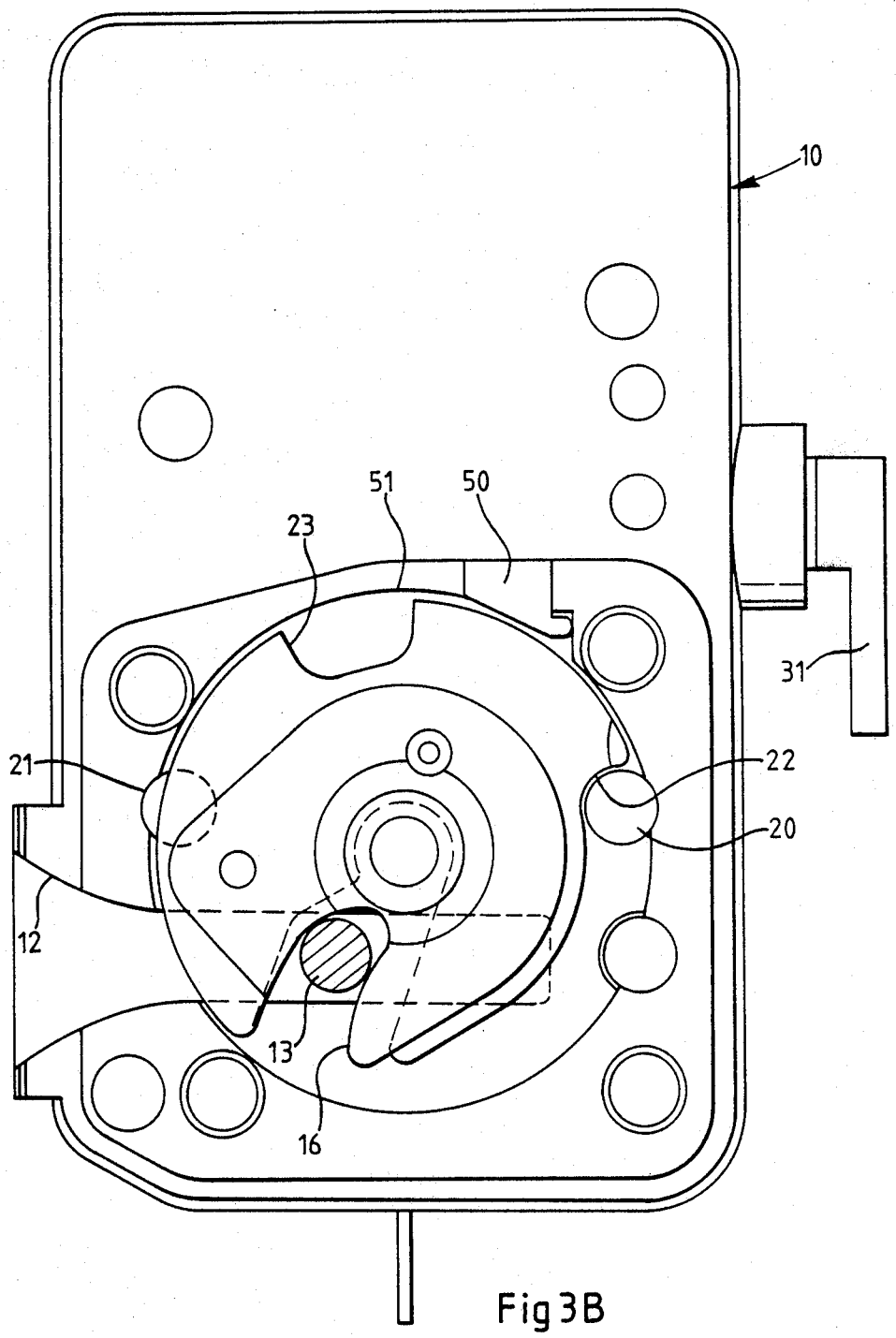

During relative inward movement of striker part 13 along slot 11 said part engages in gap 16 and rotates bolt 14 initially to the safety position shown in FIG. 3B. As this position is reached a cutaway portion of the peripheral margin of latch 14 frees the first plunger 20 so that it is resiliently extended to coact with an engaging face 22 of said cutaway portion, thus preventing clockwise rotation of latch 14 from the safety position, i.e. the striker cannot now be released from the latch unless first plunger 20 is withdrawn.

Figure 3C:
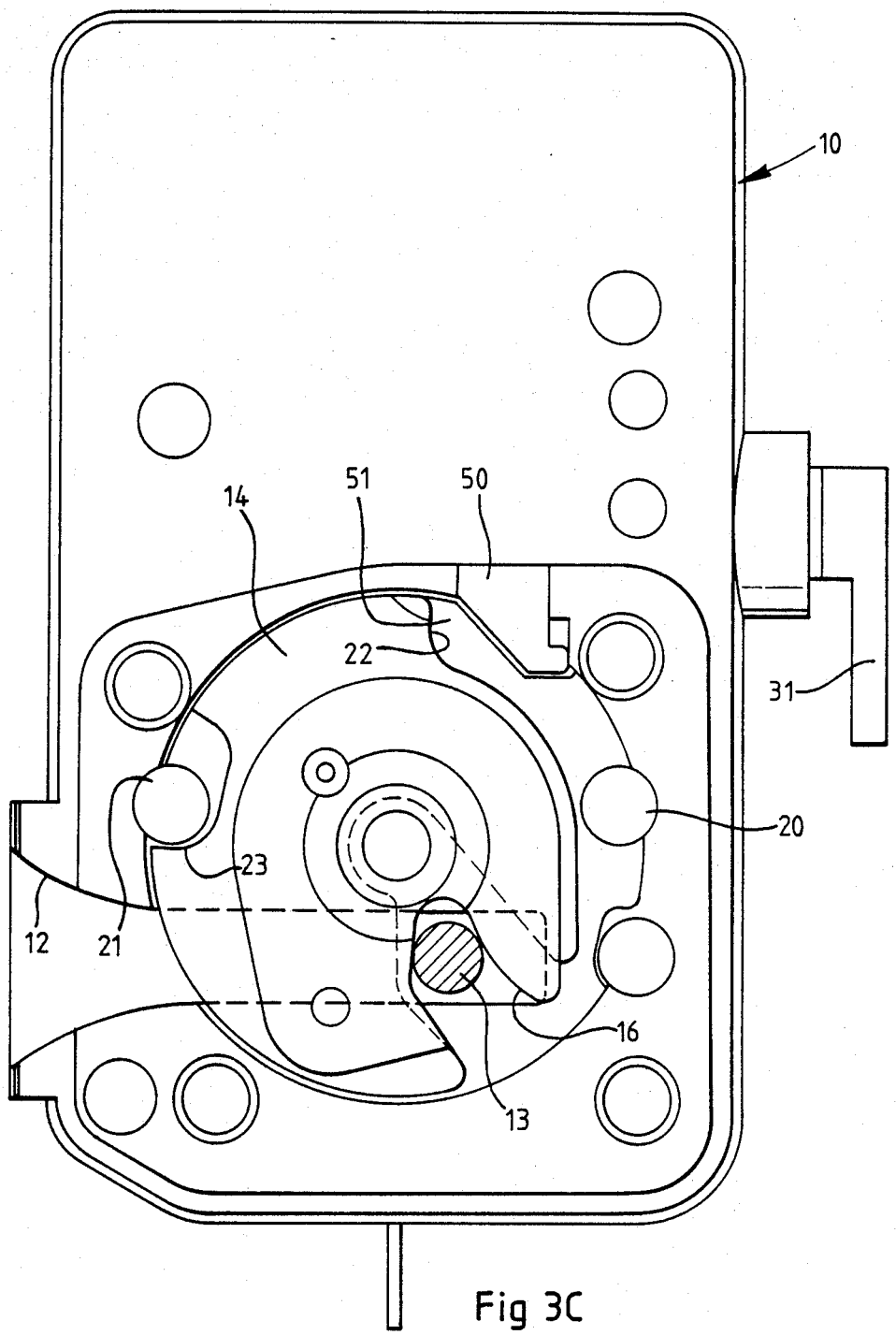

As movement of the door continues to the fully closed position (with compression of the door seals) anticlockwise rotation of bolt 14 continues to the position shown in FIG. 3C, the cutaway portion coacting with first plunger 20 being long enough to avoid obstruction of this further movement. As the fully latched position is reached a second cutout portion in the margin of the latch coacts with the second plunger 21 allowing it to extend to coact with a second engaging in face 23 of the second cutout so retaining the door at the fully closed position. It will be seen that this gives very secure fastening of the door as the forces transmitted through latch 14 are acting in shear on plunger 21 and there is no force tending to displace it from its extended condition, indeed the greater the lateral pressure on the plunger the more strongly its retraction will be resisted frictionally. If the door should not close completely or the mechanism should be inadvertently operated to free the latch from the fully latched position rotation of the latch beyond the safety position shown in FIG. 3B will be prevented by the first plunger 20.

Release means of the latch mechanism will now be described, best seen in FIGS. 2 and 4. A release fork 26 is located for angular movement on a cross shaft 27, said shaft being able to rotate independently of the fork. The fork has a pair of downwardly depending first and second limbs 28, 29 which coact respectively with heading proximal end parts 20*a*, 21*a* of plungers 20 and 21, thus angular movement of fork 26 will withdraw both plungers simultaneously out of their coacting relationship with bolt 14 to free the latter for rotation. The fork includes an integral operating arm 30 which projects upwardly within body 10 for actuation by an interior door handle as described hereafter.

One end of cross shaft 27 projects from body 10 and mounts a crank arm 31 which will be linked to an exterior handle of the door in use, operation of the latter causing angular rotation of shaft 27.

Mechanical key operated exterior locking mechanism can be incorporated in which case operation of the door key will selectively interconnect or free shaft 27 from driving engagement with the release fork 26, when shaft 27 is free to rotate independently of fork 26 plungers 20 or 21 cannot be withdrawn by operation of the exterior door handle i.e. the door is locked (though the fork can still be displaced by actuation of its integral arm 30 i.e. by use of the interior door handle).

In the example of the invention shown in the drawings locking is carried out by remote control, e.g. from an electrically powered central locking system of known type, by a servo actuator, in this case a small electric motor 35 built into the upper part of body 10. Motor 35 drives a worm shaft 36 through a gear train 37 as best seen in FIG. 4, said shaft carrying a follower 38 which is shifted along the shaft as it rotates.

Follower 38 coacts with a drive dog 39 in sliding engagement with a central region of cross shaft 27, the dog being selectively shifted longitudinally of shaft 27 by the operation of motor-35 in forward or reverse directions to make or break driving connection between cross shaft 27 and the release fork 26, thus unlocking or locking the latch respectively according to whether fork 26 can be displaced by operation of the exterior door handle.

Many known types of vehicle door latch in common use are actuated, at least so far as the interior door handle is concerned, by connection of a pull cable of other tension link between an arm or the like of the latch mechanism and the door handle, the latter is normally spaced some distance from the latch and the cable or other tension member extends across the inside of the door. The trim panels or other interior facings or walls of vehicle doors are usually formed of material of light gauge and/or low strength and have little resistance to buckling or damage on impact from the inside of the car. Safety authorities are becoming increasingly concerned about the risk of occupants of the vehicle being thrown against the doors in an accident, particularly in cases of sideways collision, with the danger that the door may open and the occupant be thrown out. While the door latch itself may have the required degree of burst resistance (and the latch of the present invention is particularly good in this respect) there is still a danger that distortion of the interior facing parts of the door will displace or bend the latch operating linkage if it acts in tension, so effectively shortening it and in itself releasing the latch so that the door can swing open.

In the present construction any risk of this happening is completely avoided. Referring to FIG. 7 it will be seen that the operating arm 30 of release fork 26 presents a flat abutment face which is directed towards a guide opening 45 in an upper part of the inner side wall of body 10 i.e. directed towards the interior of the door when fitted. A rubber grommet 46 is located in opening 45 to reduce rattling and noise and, in use, the end part of an operating pushrod 47 locates in grommet 46 so that the tip of the rod abuts arm 30 to move fork 26 angularly and release the latch when the interior door handle is operated. Arm 30 is resiliently urged toward opening 45 by a spring 48. If pushrod 47 is bent or displaced laterally this will tend to withdraw its end from opening 45 but, as it is not linked to arm 30, the latter will not be displaced and the door will remain fully fastened.

This example of the invention also includes sensor means for monitoring its operation in the form of a sensor microswitch (not shown) within body 10 actuated by a sensing plunger 50 (FIG. 3) which is urged into camming engagement with the periphery of a disc formation 51 rotating in common with bolt 14. When the bolt is at its fully latched position (FIG. 3C) plunger 50 coacts with a notch in the periphery of formation 51 to actuate the switch, thus providing a signal derived directly from the latch position showing that the door is fully closed. The switch may, of course, be arranged to be on or off at this position and the signal so derived may be employed in various ways in connection with the servo actuating mechanism of the associated doors and/or the other doors of the vehicle and/or in connection with other facilities. For example circuits connected to the switch may provide a warning indication that one or more of the vehicle doors are incompletely closed and/or to inhibit operation of a central locking system if any door is not fully latched and/or operating an interior courtesy light or the like when a door opens. The sensor switch may also be used in other ways, e.g. to bring a passenger restraint system into full operation once all the vehicle doors have been closed, and/or in conjunction with a central locking system to cancel the "all doors locked" mode of the system if it has been actuated while the car is occupied e.g. as an anti-hijack measure once a door is opened from the inside to ensure that the central locking system is de-activated so that the doors can be opened from the outside in the normal way when closed again e.g. after the occupants have left the car.

While the plunger type pawl means are preferred as the retention means of the invention as giving maximum security and simplicity and reliability of operation it is to be understood that other forms of first and second pawl members could be used in coaction with the latch, for example cam shaped pawls which are rotated to bring them into or out of coacting relationship with engaging faces or other formations of the bolt.

It will be noted that each pawl member is shifted once only in one direction and over a relatively short distance during each latching cycle, thus their inertia is low with corresponding enhanced speed of response and reduced noise levels during operation.

It will be seen that substantially the whole of the latch mechanism is totally enclosed within the box-like body 10 and this, together with the face that the releasing movement of the pawls is in a horizontal direction makes it extremely difficult for unauthorised persons to gain access to or meddle with the latch mechanism in an attempt to unlock the door from the exterior and gain access to the vehicle. For example there is nothing which can be reached or displaced by inserting probes or hooks into the interior of the door e.g. through the window seals. Moreover the pushrod arrangement referred to above makes it impossible to unlatch the door by attempting to engage rod 47 and pull it out of position.

Thus the invention provides an extremely secure latch both from the point of view of the safety of the occupants of the vehicle and from the point of view of the safety of the vehicle itself when left unattended.

While, in the arrangement described above, the latch can always be released by use of the interior door handle due to the latter acting on the release fork 26, it will be appreciated that in an alternative arrangement the interior handle may be connected to operate the cross shaft 27 in the same way as the exterior handle thus preventing the door from being opened when locked using either handle. This may be desirable (or may be required by regulations in some countries) for example in the case of the rear doors of a vehicle e.g. for child safety.

While servo operation using a power actuator in the form of a rotary electric motor has been described above, other forms of power actuator may be used, for example a solenoid or a pneumatic or other fluid driven actuator.

I claim:

1. A latch assembly for releasably latching a vehicle door in a closed position to a vehicle door frame including a latch bolt in the form of a rotatably mounted claw formation defining a mouth with which a cylindrical portion of an interacting striker formation of the door frame cooperates to latch the door; retention means cooperating with the bolt to hold it at a latched position keeping the door fully closed and at a safety position at which opening movement of the door beyond a near closed position is prevented; and release means connected to operating means of the door to actuate the retention means for freeing the bolt to allow the door to open; characterized in that the retention means includes first and second pawl members guided for movement in respective rectilinear paths each parallel to an axis about which said latch bolt rotates, each said pawl member being resiliently urged independently of the other into coacting relationship with the bolt, the first pawl holding the bolt at the safety position and the second pawl holding the bolt at the latched position; and in that the release means acts to shift both pawl members to free the bolt and allow the door to open in use.

2. An assembly as in claim 1 characterized in that each pawl member coacts with a separate respective engaging face of the bolt.

3. An assembly as in claim 1 characterized in that each pawl makes only one unidirectional movement during a full operating cycle in which the bolt is shifted to the latched position.

4. An assembly as in claim 1 characterized in that it includes a body formation within which the release means is enclosed, the pawl members being guided for movement within said body formation relative to the latch bolt.

5. An assembly as in claim 1 characterized in that the release means includes an actuator element, clutch means forming a selectively disconnectable drive connection between said actuator element and the pawl members, and a power operated actuator for selective operation of the clutch means whereby said drive connection can be connected and disconnected by remote control.

6. An assembly as in claim 1 characterized by sensor means disposed for actuation in response to rotation of the latch bolt to provide an output signal which is a function of the angular position of said bolt.

7. An assembly as in claim 6 characterized in that the sensor means is actuated in response to movement of the latch bolt to or from the latched position.

8. An assembly as in claim 1 characterized in that the release means includes a formation which is pushed inwardly of the assembly for actuating the retention means to free the bolt, said release means further including an element transmitting movement from the operating means in use which is in abutment with said formation but is not otherwise linked thereto.

* * * * *